US009310736B1

(12) United States Patent
Onishi

(10) Patent No.: US 9,310,736 B1
(45) Date of Patent: Apr. 12, 2016

(54) FIXING DEVICE AND IMAGE FORMING APPARATUS INCLUDING THE SAME

(71) Applicant: KYOCERA Document Solutions Inc., Osaka (JP)

(72) Inventor: Shota Onishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/920,349

(22) Filed: Oct. 22, 2015

(30) Foreign Application Priority Data

Oct. 27, 2014 (JP) ..... 2014-218015

(51) Int. Cl.
*G03G 15/20* (2006.01)

(52) U.S. Cl.
CPC ..... *G03G 15/2089* (2013.01)

(58) Field of Classification Search
CPC ..... G03G 15/2089
See application file for complete search history.

(56) References Cited

U.S. PATENT DOCUMENTS 4,589,758 A * 5/1986 Kasama ..... G03G 15/2092 219/216
5,708,926 A * 1/1998 Sagara ..... G03G 15/2064 399/122
8,050,608 B2 * 11/2011 Chang ..... G03G 15/206 399/328

FOREIGN PATENT DOCUMENTS

JP 2013-137580 7/2013

* cited by examiner

*Primary Examiner* — G. M. Hyder
(74) *Attorney, Agent, or Firm* — Wenderoth, Lind & Ponack, L.L.P.

(57) ABSTRACT

In a state in which a swing lever has been driven to a first swing position by a driving mechanism, a compression coil spring has a natural length and a tension coil spring has a first predetermined length longer than a natural length, so that press-contact force between both the rollers becomes first press-contact force. On the other hand, in a state in which the swing lever has been driven to a second swing position by the driving mechanism, the compression coil spring has a second predetermined length shorter than the natural length and the tension coil spring has the natural length, so that the press-contact force between both the rollers becomes second press-contact force.

4 Claims, 6 Drawing Sheets

FIXING DEVICE AND IMAGE FORMING APPARATUS INCLUDING THE SAME

CROSS-REFERENCE TO RELATED APPLICATION

This application is based upon and claims the benefit of priority from Japanese Patent Application No. 2014-218015 filed on Oct. 27, 2014, the entire contents of which are incorporated herein by reference.

BACKGROUND

The technology of the present disclosure relates to an image forming apparatus such as a printer, a copy machine, a facsimile, and a multifunctional peripheral thereof and a fixing device mounted in the image forming apparatus.

Conventionally, there has been proposed a fixing device capable of switching press-contact force between a fixing roller and a pressing roller abutting the fixing roller in an abutting state to first press-contact force and second press-contact force smaller than the first press-contact force. In this fixing device, while the press-contact force between both the rollers is set to the first press-contact force with respect to a normal paper, the press-contact force between both the rollers is set to the second press-contact force with respect to an envelope or a thin paper. In this way, wrinkles are prevented from occurring by excessive press-contact force applied to the envelope or the thin paper. In this fixing device, two springs are used in order to switch the press-contact force between both the rollers. When the press-contact force between both the rollers is set to the first press-contact force, resultant force of the two springs is applied to the pressing roller, and when the press-contact force between both the rollers is set to the second press-contact force, a pressing lever is released, so that the resultant force of the two springs applied to the pressing roller is made zero.

SUMMARY

A fixing device according to one aspect of the present disclosure includes a fixing roller, a pressing roller abutting the fixing roller in a press contact state, a frame member, and a pressure switching mechanism. The frame member rotatably supports each of the fixing roller and the pressing roller. The pressure switching mechanism is configured to be able to switch press-contact force between the fixing roller and the pressing roller to first press-contact force and second press-contact force different from the first press-contact force.

The pressure switching mechanism includes first and second support shafts, a pressing lever, a compression coil spring, a tension coil spring, and a driving mechanism. The first and second support shafts protrude from the frame member. The pressing lever is rotatably supported to the first support shaft. The pressing lever is provided at one end portion thereof with a bearing part that rotatably supports the pressing roller. One end portion of the compression coil spring abuts the other end portion of the pressing lever. The other end portion of the compression coil spring abuts a fixed seat portion provided to the frame member. The compression coil spring is configured to be able to urge the pressing lever around the first support shaft such that the pressing roller is brought into press-contact with the fixing roller. The tension coil spring is provided at an opposite side of the compression coil spring while interposing the pressing lever between the tension coil spring and the compression coil spring. One end portion of the tension coil spring is connected to the other end portion of the pressing lever. The other end portion of the tension coil spring is connected to a swing lever swingably supported to the second support shaft. The tension coil spring is configured to be able to urge the pressing lever around the first support shaft such that the pressing roller is brought into press-contact with the fixing roller. The driving mechanism drives the swing lever between a first swing position and a second swing position.

In the fixing device, in a state in which the swing lever has been driven to the first swing position by the driving mechanism, the compression coil spring has a natural length and the tension coil spring has a first predetermined length longer than a natural length, so that press-contact force of the pressing roller with respect to the fixing roller becomes the first press-contact force. On the other hand, in a state in which the swing lever has been driven to the second swing position by the driving mechanism, the compression coil spring has a second predetermined length shorter than the natural length and the tension coil spring has the natural length, so that the press-contact force of the pressing roller with respect to the fixing roller becomes the second press-contact force.

DETAILED DESCRIPTION

Hereinafter, an example of an embodiment will be described in detail with reference to the drawings. It is noted that the technology of the present disclosure is not limited to the following embodiment.

Embodiment

Figure 1:
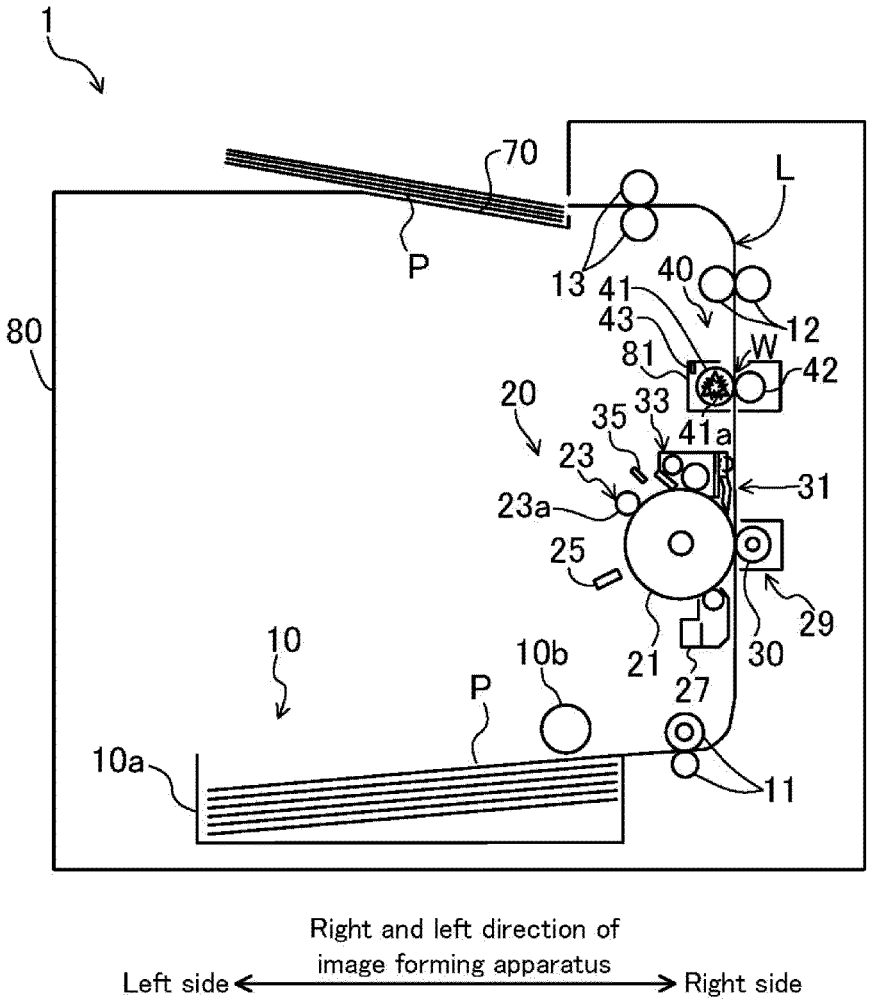
FIG. 1 is a schematic view illustrating an image forming apparatus including a fixing device in an embodiment.

FIG. 1 illustrates an image forming apparatus 1 in the present embodiment. In the present embodiment, the image forming apparatus 1 includes a monochrome laser printer. The image forming apparatus 1 has a paper feeding unit 10, an image creating unit 20, a fixing device 40, a paper discharge unit 70, and a housing 80. On a paper conveyance path from the paper feeding unit 10 to the paper discharge unit 70, a plurality of conveying roller pairs 11 to 13 are arranged to convey a paper P while interposing it therebetween. In the following description, it is noted that a "front side" and a "rear side" indicate a front side and a rear side (a front side and a back side in a direction vertical to the paper surface of FIG. 1) of the image forming apparatus 1, and a "left side" and a "right side" indicate a left side and a right side when the image forming apparatus 1 is viewed from the front side.

The paper feeding unit 10 has a paper feeding cassette 10*a* in which the paper P having a sheet shape is accommodated, and a pick-up roller 10*b* for taking out the paper P in the paper feeding cassette 10*a* and sending the paper P to an exterior of the cassette. The paper P sent to the exterior of the cassette from the paper feeding cassette 10*a* is supplied to the image creating unit 20 via the conveying roller pair 11.

The image creating unit 20 is arranged at an intermediate portion of a right end portion in the housing 80 in a vertical direction. The image creating unit 20 has a photosensitive drum 21, wherein around the photosensitive drum 21, a charging device 23, an exposure device 25, a developing device 27, a transfer device 29, a cleaning device 33, and an electricity removing device 35 are sequentially arranged in a counterclockwise direction of FIG. 1 on the basis of a 10 o'clock direction.

At the time of image formation, a peripheral surface of the photosensitive drum 21 is firstly electrified by the charging device 23. Then, laser light based on document image data (for example, image data of a document image received from an external terminal) is irradiated to the peripheral surface of the photosensitive drum 21 by the exposure device 25. In this way, an electrostatic latent image corresponding to the document image data is formed on the surface of the photosensitive drum 21. The electrostatic latent image formed on the peripheral surface of the photosensitive drum 21 is developed by the developing device 27 as a toner image. The toner image developed in this way is transferred to the paper P supplied from the paper feeding unit 10 when the paper P passes through between the photosensitive drum 21 and a transfer roller 30. Remaining toner remaining on the peripheral surface of the photosensitive drum 21 after the toner image is transferred to the paper P is collected by the cleaning device 33, and charge of the peripheral surface of the photosensitive drum 21 is removed by the electricity removing device 35. On the other hand, the paper P with the transferred toner image is sent out to the fixing device 40 positioned at a downstream side of the transfer device 29 (the transfer roller 30) and the photosensitive drum 21 by the transfer device 29 and the photosensitive drum 21. It is noted that a reference numeral 31 of FIG. 1 is a separating device that separates the paper P from the photosensitive drum 21 such that the paper P is not rolled into the cleaning device 33.

The aforementioned fixing device 40 has a fixing roller 41 having a heater 41*a* (see FIG. 4) therein, a pressing roller 42 brought into press-contact with the fixing roller 41, and a box-like case body 81 that accommodates both the rollers 41 and 42 therein. In the fixing device 40, the paper P supplied by the image creating unit 20 is interposed by the fixing roller 41 and the pressing roller 42 and is conveyed, so that the toner image is thermally fixed to the paper P. Then, the paper P with the toner image thermally fixed by the fixing device 40 is sent out to the downstream side by both the rollers 41 and 42. The paper P sent out from the fixing device 40 is discharged to the aforementioned paper discharge unit 70 formed on an upper surface of the housing 80 via a plurality of the conveying roller pairs 12 and 13.

The aforementioned fixing device 40 has a pressure switching mechanism 50 that switches press-contact force between the fixing roller 41 and the pressing roller 42 to first press-contact force set in advance and second press-contact force smaller than the first press-contact force. When a normal print mode has been set by an operating unit (not illustrated, for example, including a liquid crystal touch panel and user operating buttons), the press-contact force between both the rollers 41 and 42 is switched to the first press-contact force by the pressure switching mechanism 50, and when an envelop print mode has been set by the operating unit, the press-contact force between both the rollers 41 and is switched to the second press-contact force by the pressure switching mechanism 50. In this way, in the case of performing printing on an envelope having a thickness as compared with a normal paper, wrinkles are prevented from occurring in the envelope due to excessive press-contact force between both the rollers 41 and 42.

Figure 2:
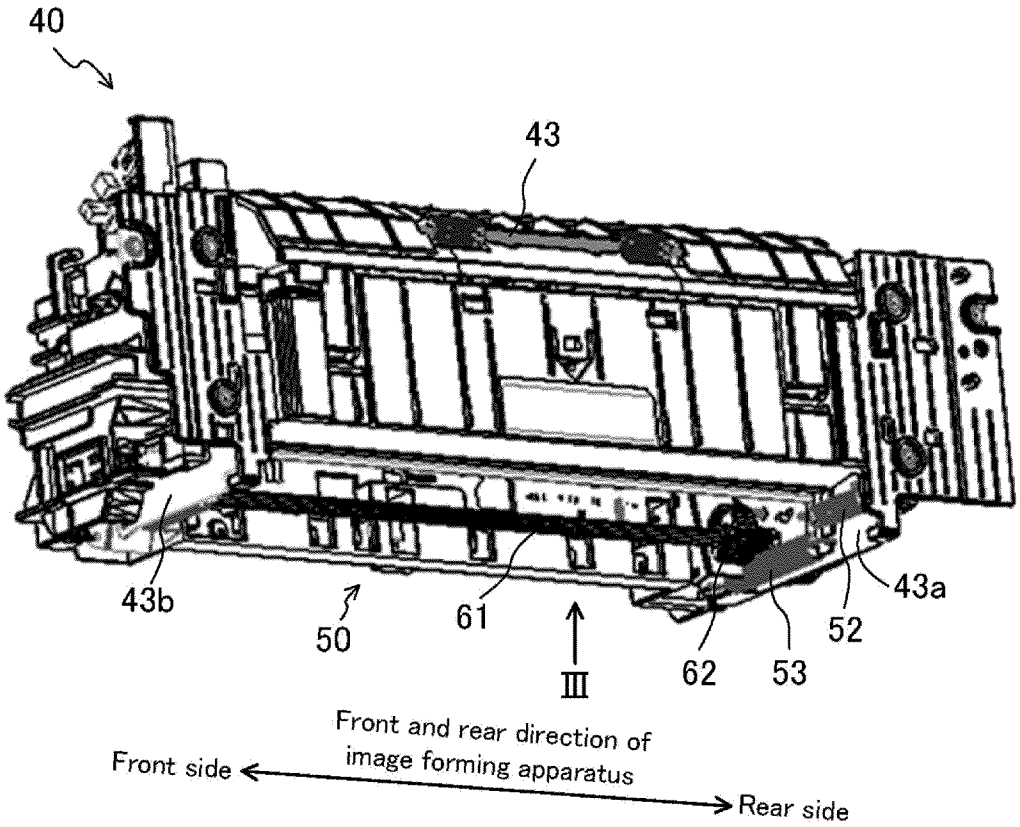
FIG. 2 is a perspective view illustrating a fixing device when viewed from a position closer to a front side of a right side of an image forming apparatus.

FIG. 2 is a perspective view when the aforementioned fixing device 40 is viewed from a position closer to an obliquely right side of the front side of the image forming apparatus 1. The fixing device 40 has a rectangular box-like housing frame (a frame member) 43 that accommodates the fixing roller 41 and the pressing roller 42 therein. The fixing roller 41 and the pressing roller 42 extend in the front and rear direction of the image forming apparatus 1 in the housing frame 43. In the present embodiment, the fixing roller 41 is a driving roller driven by a driving motor and the pressing roller 42 is a driven roller that is rotated according to the driving roller.

Figure 3:
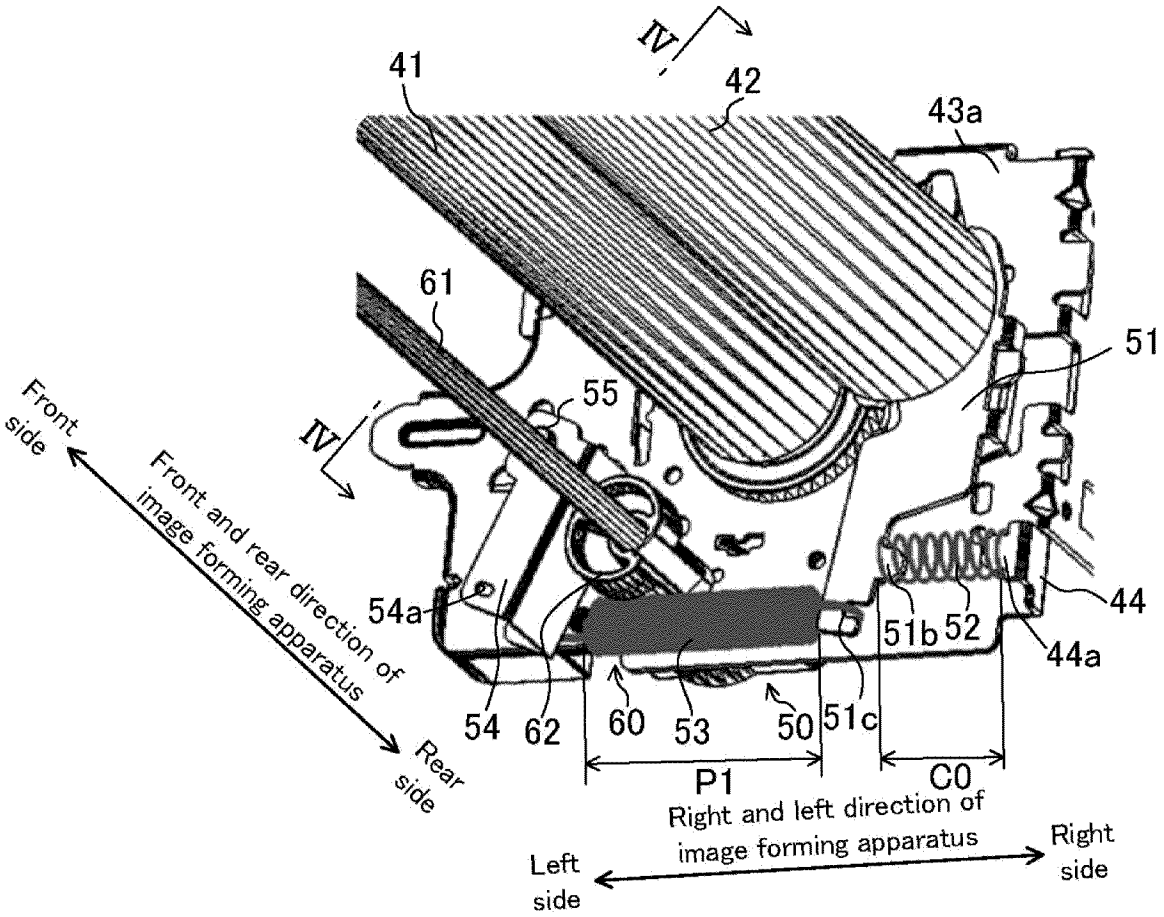
FIG. 3 is a view viewed in the arrow direction of III of FIG. 2 and is a view illustrating the state in which a swing lever is positioned at a first swing position.
Figure 4:
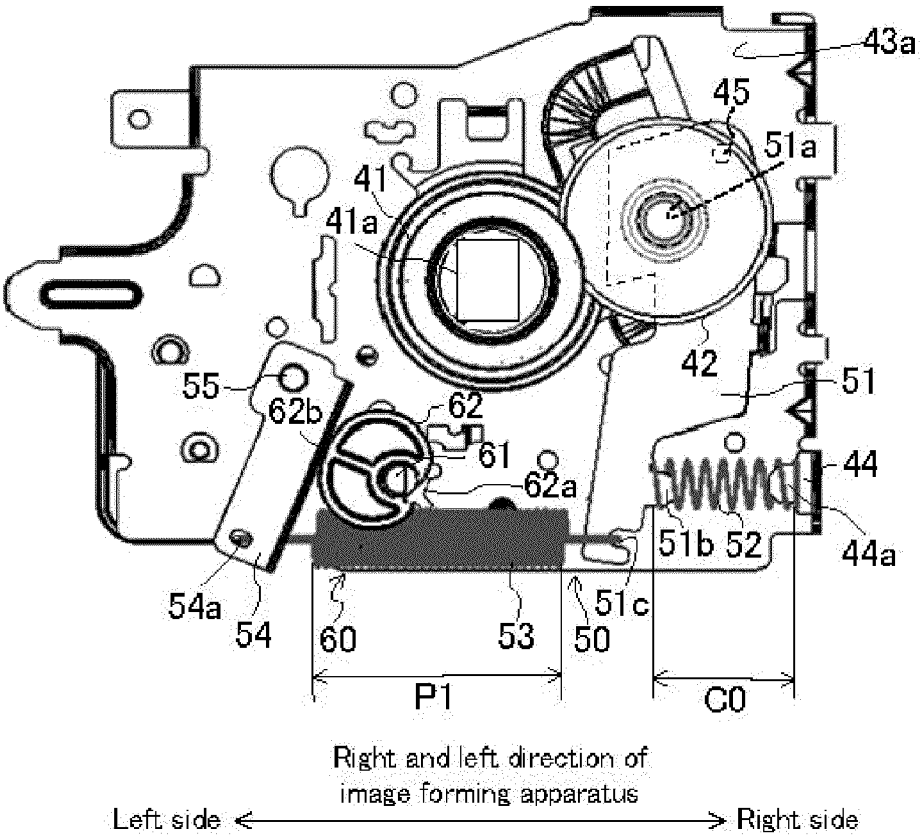
FIG. 4 is a sectional view taken along line IV-IV of FIG. 3.

As illustrated in FIG. 3 and FIG. 4, the aforementioned pressure switching mechanism 50 has pressing levers 51, a compression coil spring 52, a tension coil spring 53, a swing lever 54, and a cam mechanism (a driving mechanism) 60. The number of pressing levers 51 provided spaced apart from each other in the front and rear direction is two (FIG. 3 and FIG. 4 illustrates only the pressing lever 51 of the rear side).

The pressing lever 51 includes a plate material made of sheet material and long in a vertical direction. An upper end portion of the pressing lever 51 is rotatably supported to a first support shaft 45 (see FIG. 4). The first support shaft 45 protrudes to the inside (the front side) of the housing from a rear sidewall 43*a* of the housing frame 43. At a side slightly lower than a rotation fulcrum of the upper end portion of the pressing lever 51, a bearing hole (a bearing part) 51*a* is formed to rotatably support a roller shaft of the pressing roller 42. At right end edges of a lower end portion of the pressing lever 51, a spring insertion protruding part 51*b* and a spring locking concave part 51*c* are formed. The spring locking concave part 51*c* is positioned below the spring insertion protruding part 51*b*. That is, a distance from the rotation fulcrum of the pressing lever 51 (a shaft line of the first support shaft 45) to the spring locking concave part 51*c* is larger than a distance from the rotation fulcrum to the spring insertion protruding part 51*b*.

The aforementioned compression coil spring 52 is arranged such that its shaft line extends in a right and left direction. A left end portion of the compression coil spring 52 is inserted into the spring insertion protruding part 51*b* and abuts a lower end portion of the pressing lever 51. A right end portion of the compression coil spring 52 abuts a fixed bracket (a fixed seat portion) 44 protruding from the rear sidewall 43*a* of the housing frame 43. The fixed bracket 44 is formed in an L shape when viewed from an upper side (see FIG. 3), and a spring insertion protruding part 44*a*, into which the other end portion of the compression coil spring 52 is inserted, is formed at a front end portion of the fixed bracket 44. The compression coil spring 52 can urge the lower end portion of the pressing lever 51 leftward, thereby urging the pressing lever 51 in a clockwise direction (that is, a direction in which the pressing roller 42 is brought into press-contact with the fixing roller 41) of the drawing around the first support shaft 45.

The aforementioned tension coil spring 53 is arranged at an opposite side of the compression coil spring 52 while interposing the pressing lever 51 between the tension coil spring 53 and the compression coil spring 52. Similarly to the compression coil spring 52, the aforementioned tension coil spring 53 is arranged such that its shaft line extends in the right and left direction. A right end portion of the tension coil spring 53 forms a hook shape to be locked (connected) to the spring locking concave part 51*c* of the lower end portion of the pressing lever 51. A left end portion of the tension coil spring 53 forms the same hook shape to be locked (connected) to a locking hole 54*a* formed in the aforementioned swing lever 54. Accordingly, the tension coil spring 53 can urge the pressing lever 51 in the clockwise direction (that is, the direction in which the pressing roller 42 is brought into press-contact with the fixing roller 41) of the drawing around the first support shaft 45.

The aforementioned swing lever 54 includes a sheet metal member having a sectional U shape. One end portion of the swing lever 54 in a longitudinal direction is swingably supported to a second support shaft 55 protruding forward from the rear sidewall 43*a*. The swing lever 54 is formed at the other end portion thereof in the longitudinal direction with the locking hole 54*a* to which the left end portion of the aforementioned tension coil spring 53 is locked. The locking hole 54*a* is formed in a long hole shape for absorbing a dimensional error of a spring length of the tension coil spring 53.

The aforementioned cam mechanism 60 is a mechanism for swingably driving the swing lever 54 around the second support shaft 55. The cam mechanism 60 has a driving shaft 61, an eccentric cam part 62, and a driving motor (not illustrated). The driving shaft 61 extends in the front and rear direction across between a front sidewall 43*b* (see FIG. 2) and a rear sidewall 43*a* of the housing frame 43. A rear end portion of the driving shaft 61 is connected to the aforementioned driving motor provided to the outer side of the housing frame 43 by passing through the rear sidewall 43*a* of the housing frame 43. The eccentric cam part 62 is formed of a cylindrical body eccentrically fixed to the driving shaft 61 and having a sectional oval shape. The eccentric cam part 62 has a minimum diameter portion 62*a* having a minimum distance from a shaft line of the driving shaft 61 and a maximum diameter portion 62*b* having a maximum distance from the shaft line of the driving shaft 61. The eccentric cam part 62 is arranged at a side, at which the tension coil spring 53 is positioned, with respect to the swing lever 54. The swing lever 54 receives urging force of the tension coil spring 53 and always abuts a peripheral surface of the eccentric cam part 62. The aforementioned driving motor rotates the eccentric cam part 62 together with the driving shaft 61, thereby driving the swing lever 54 to a first swing position and a second swing position. The driving motor is also used as a motor for driving the fixing roller 41 which is a driving roller. The driving motor is connected to the fixing roller 41 and the driving shaft 61 of the aforementioned eccentric cam part 62 via a planetary gear mechanism, thereby transmitting its driving force to the fixing roller 41 at the time of positive rotation and transmitting its driving force to the driving shaft 61 at the time of negative rotation.

FIG. 3 and FIG. 4 illustrate a state in which the swing lever 54 is positioned at the aforementioned first swing position. In this state, the maximum diameter portion 62*b* of the eccentric cam part 62 abuts the swing lever 54, so that the swing lever 54 is inclined downward to a left side. Accordingly, the tension coil spring 53 is pulled to a left side by the swing lever 54, so that the length of the tension coil spring 53 in an expansion and contraction direction becomes a first predetermined length P1 longer than its natural length P0 (see FIG. 6), while the length of the compression coil spring 52 in an expansion and contraction direction becomes equal to its natural length CO. Consequently, in the state in which the swing lever 54 is positioned at the first swing position, only a spring load of the tension coil spring 53 is applied to the pressing levers 51, so that the press-contact force between both the rollers 41 and 42 is set to the first press-contact force by the spring load.

Figure 5:
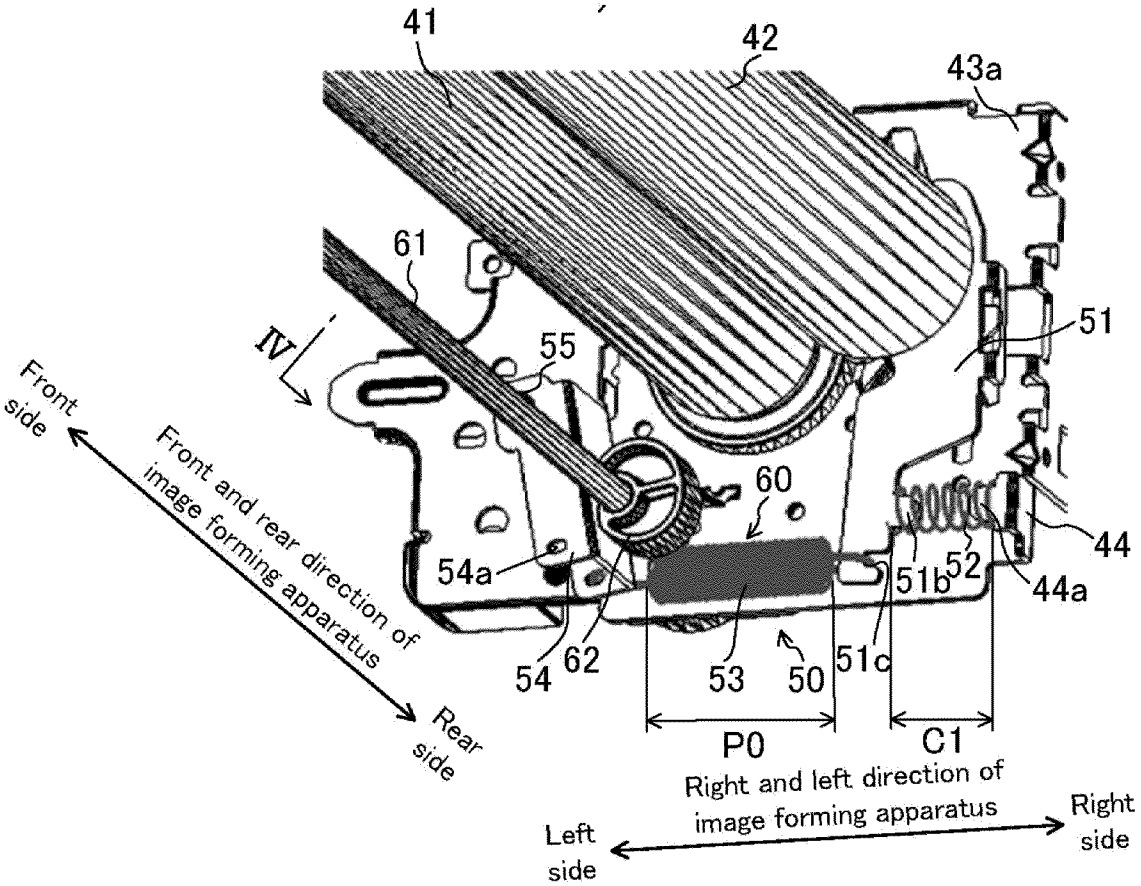
FIG. 5 is a view corresponding to FIG. 3, which illustrates the state in which a swing lever is positioned at a second swing position.
Figure 6:
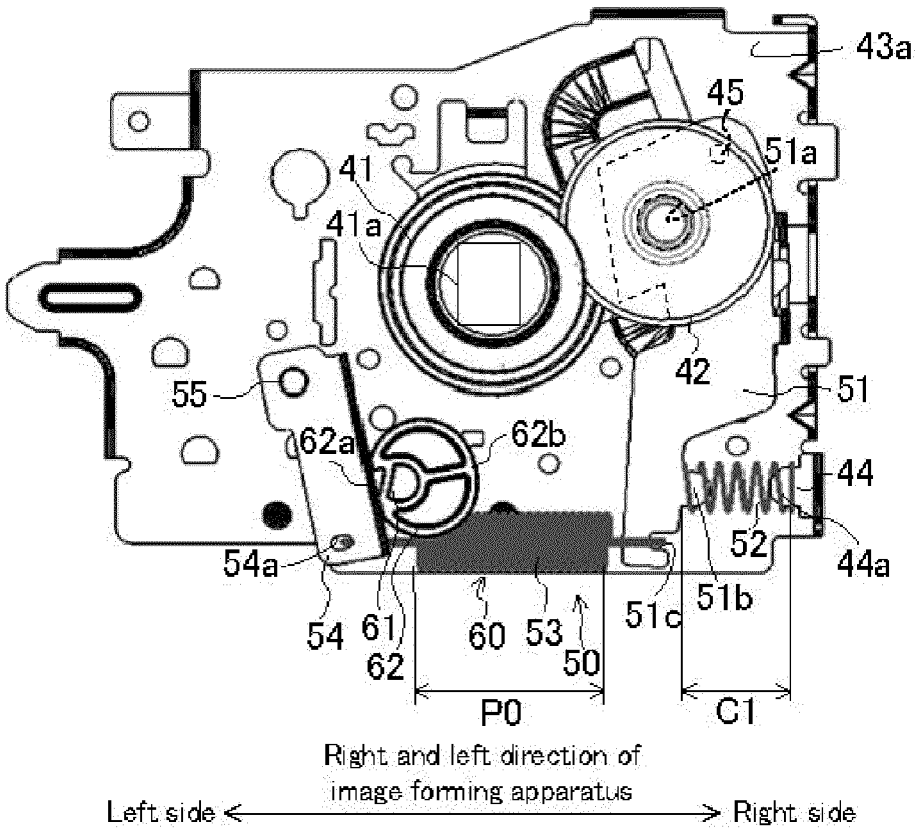
FIG. 6 is a view corresponding to FIG. 4, which illustrates the state in which a swing lever is positioned at a second swing position.

On the other hand, when the eccentric cam part 62 is rotated from the state of FIG. 3 and FIG. 4 by the driving motor in the clockwise direction of the drawing by a predetermined angle, the swing lever 54 rotates in the counterclockwise direction of the drawing while abutting the peripheral surface of the eccentric cam part 62 and is displaced from the first swing position to the second swing position. FIG. 5 and FIG. 6 illustrate a state in which the swing lever 54 is positioned at the second swing position. In this state, the minimum diameter portion 62*a* of the eccentric cam part 62 abuts the swing lever 54, so that the swing lever 54 is inclined downward to a right side and thus the length of the tension coil spring 53 in the expansion and contraction direction becomes equal to its natural length P0 while the length of the compression coil spring 52 in the expansion and contraction direction becomes a second predetermined length Cl shorter than its natural length CO. Consequently, in the state in which the swing lever 54 is positioned at the second swing position, only a spring load of the compression coil spring 52 is applied to the pressing levers 51, so that the press-contact force between both the rollers 41 and 42 is controlled to the second press-contact force by the spring load.

As described above, in the aforementioned embodiment, when the press-contact force between both the rollers 41 and 42 is switched to the first press-contact force and the second press-contact force by the pressure switching mechanism 50, since only any one of the two coil springs 52 and 53 generates a spring load, the spring load of the other one becomes zero (the natural length). Consequently, variations of the two spring loads are accumulated, so that it is possible to prevent the press-contact force between both the rollers 41 and 42 from significantly deviating from target values (the first press-contact force and the second press-contact force).

Furthermore, in the aforementioned embodiment, it is possible to easily switch the pressing lever 51 to the first swing position and the second swing position by using the rotational motion of the eccentric cam part 62 of the cam mechanism 60. Furthermore, the driving motor for driving the aforementioned eccentric cam part 62 is allowed to be also used as a motor for driving the aforementioned fixing roller 41, so that it is possible to reduce the number of parts and thus reduce the entire cost of the fixing device.

Furthermore, since the image forming apparatus 1 in the aforementioned embodiment includes the aforementioned fixing device 40, the press-contact load between both the rollers 41 and 42 does not significantly deviate from the target values (the first press-contact load and the second press-contact load). Thus, it is possible to reliably suppress print failure occurring when the press-contact load between both the rollers and 42 becomes less than the target values, and wrinkles occurring in a printed matter (a paper or an envelope) due to an excessive press-contact load.

Other Embodiments

In the aforementioned embodiment, the case in which the fixing roller 41 is a driving roller and the pressing roller 42 is a driven roller has been described. However, the present invention is not limited thereto, and the pressing roller 42 may also be a driving roller and the fixing roller 41 may also be a driven roller.

In the aforementioned embodiment, the pressure switching mechanism 50 moves the pressing roller 42 with respect to the fixing roller 41, thereby switching both the rollers 41 and 42 to the pressing state and the pressing release state; however, the present invention is not limited thereto. That is, the pressure switching mechanism 50 may also be configured to move the fixing roller 41 with respect to the pressing roller 42, thereby switching both the rollers 41 and 42 to the pressing state and the pressing release state.

In the aforementioned embodiment, the example, in which the press-contact force between the fixing roller 41 and the pressing roller 42 becomes the first press-contact force when the swing lever 54 is positioned at the first swing position and becomes the second press-contact force when the swing lever 54 is positioned at the second swing position, has been described. In contrast to this, when the swing lever 54 is positioned at the first swing position, the press-contact force between the fixing roller 41 and the pressing roller 42 may also be allowed to become the second press-contact force, and when the swing lever 54 is positioned at the second swing position, the press-contact force between both the rollers 41 and 42 may also be allowed to become the first press-contact force.

As described above, the present invention is useful in an image forming apparatus such as a printer, a copy machine, a facsimile, and a multifunctional peripheral thereof and a fixing device mounted in the image forming apparatus.

What is claimed is:

1. A fixing device comprising:

a fixing roller;

a pressing roller abutting the fixing roller in a press contact state;

a frame member that rotatably supports each of the fixing roller and the pressing roller; and a pressure switching mechanism that is able to switch press-contact force between the fixing roller and the pressing roller to first press-contact force and second press-contact force different from the first press-contact force, wherein the pressure switching mechanism comprises:

first and second support shafts protruding from the frame member;

a pressing lever rotatably supported to the first support shaft and provided at one end portion thereof with a bearing part that rotatably supports the pressing roller;

a compression coil spring having one end portion abutting a remaining end portion of the pressing lever and a remaining end portion abutting a fixed seat portion provided to the frame member, and being able to urge the pressing lever around the first support shaft such that the pressing roller is brought into press-contact with the fixing roller;

a tension coil spring provided at an opposite side of the compression coil spring while interposing the pressing lever between the tension coil spring and the compression coil spring, having one end portion connected to the remaining end portion of the pressing lever and a remaining end portion connected to a swing lever swingably supported to the second support shaft, and being able to urge the pressing lever around the first support shaft such that the pressing roller is brought into press-contact with the fixing roller; and a driving mechanism that drives the swing lever to a first swing position and a second swing position, wherein in a state in which the swing lever has been driven to the first swing position by the driving mechanism, the compression coil spring has a natural length and the tension coil spring has a first predetermined length longer than a natural length, so that press-contact force of the pressing roller with respect to the fixing roller becomes the first press-contact force, while in a state in which the swing lever has been driven to the second swing position by the driving mechanism, the compression coil spring has a second predetermined length shorter than the natural length and the tension coil spring has the natural length, so that the press-contact force of the pressing roller with respect to the fixing roller becomes the second press-contact force.

2. The fixing device of claim 1, wherein the driving mechanism comprises:

a driving shaft;

an eccentric cam part provided at a side, at which the tension coil spring is positioned, with respect to the swing lever, eccentrically fixed to the driving shaft, and having a peripheral surface abutting the swing lever; and a driving motor connected to be able to transmit power to the driving shaft, wherein the driving mechanism is configured to rotationally drive the eccentric cam part by the driving motor to be able to drive the swing lever to the first swing position and the second swing position.

3. The fixing device of claim 2, wherein the driving motor is used also as a motor for driving the fixing roller or the pressing roller.

4. An image forming apparatus including the fixing device of claim 1.

* * * * *